US006299756B1

(12) United States Patent
Marttila

(10) Patent No.: US 6,299,756 B1
(45) Date of Patent: Oct. 9, 2001

(54) SEPARATING MEMBER FOR SEPARATING THE TANK BOTTOM PART THE REST OF THE TANK

(75) Inventor: Tom Marttila, Kirkkonummi (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/486,015

(22) PCT Filed: Aug. 26, 1998

(86) PCT No.: PCT/FI98/00655

§ 371 Date: Apr. 3, 2000

§ 102(e) Date: Apr. 3, 2000

(87) PCT Pub. No.: WO99/11841

PCT Pub. Date: Mar. 11, 1999

(30) Foreign Application Priority Data

Aug. 29, 1997 (FI) ..... 973565

(51) Int. Cl.[7] ..... B01D 59/50; B23H 3/00
(52) U.S. Cl. ..... 205/705; 204/269; 134/8
(58) Field of Search ..... 204/279, 242, 204/269; 205/766, 705, 751; 134/6, 8

(56) References Cited

U.S. PATENT DOCUMENTS 3,708,415 1/1973 Hubbard .
4,214,964 7/1980 Cannell .
4,303,491 * 12/1981 Ferrari et al. ..... 204/279
5,543,020 * 8/1996 Sitges Menendez et al. ..... 204/233

FOREIGN PATENT DOCUMENTS 0 646 662 4/1995 (EP) .
2045801 11/1980 (GB) .

* cited by examiner

*Primary Examiner*—Kathryn Gorgos
*Assistant Examiner*—Wesley A. Nicolas
(74) *Attorney, Agent, or Firm*—Smith-Hill and Bedell

(57) ABSTRACT

The invention relates to a separating member for separating the bottom part of an electrolytic tank from the rest of the tank space in connection with the removal of solids (6) settled onto the bottom of the electrolytic tank (1). According to the invention, in the electrolytic tank (1) there are installed support and control members (10), which form the trajectory of the separating member (11, 21, 31), so that the separating member (11, 21, 31) can be inserted in the electrolytic tank (1) and removed therefrom via a space left in between at least one rear wall (7, 32) of the electrolytic tank (1) and the electrode (2) located nearest to said rear wall (7, 32).

15 Claims, 4 Drawing Sheets

SEPARATING MEMBER FOR SEPARATING THE TANK BOTTOM PART THE REST OF THE TANK

Figure 1:
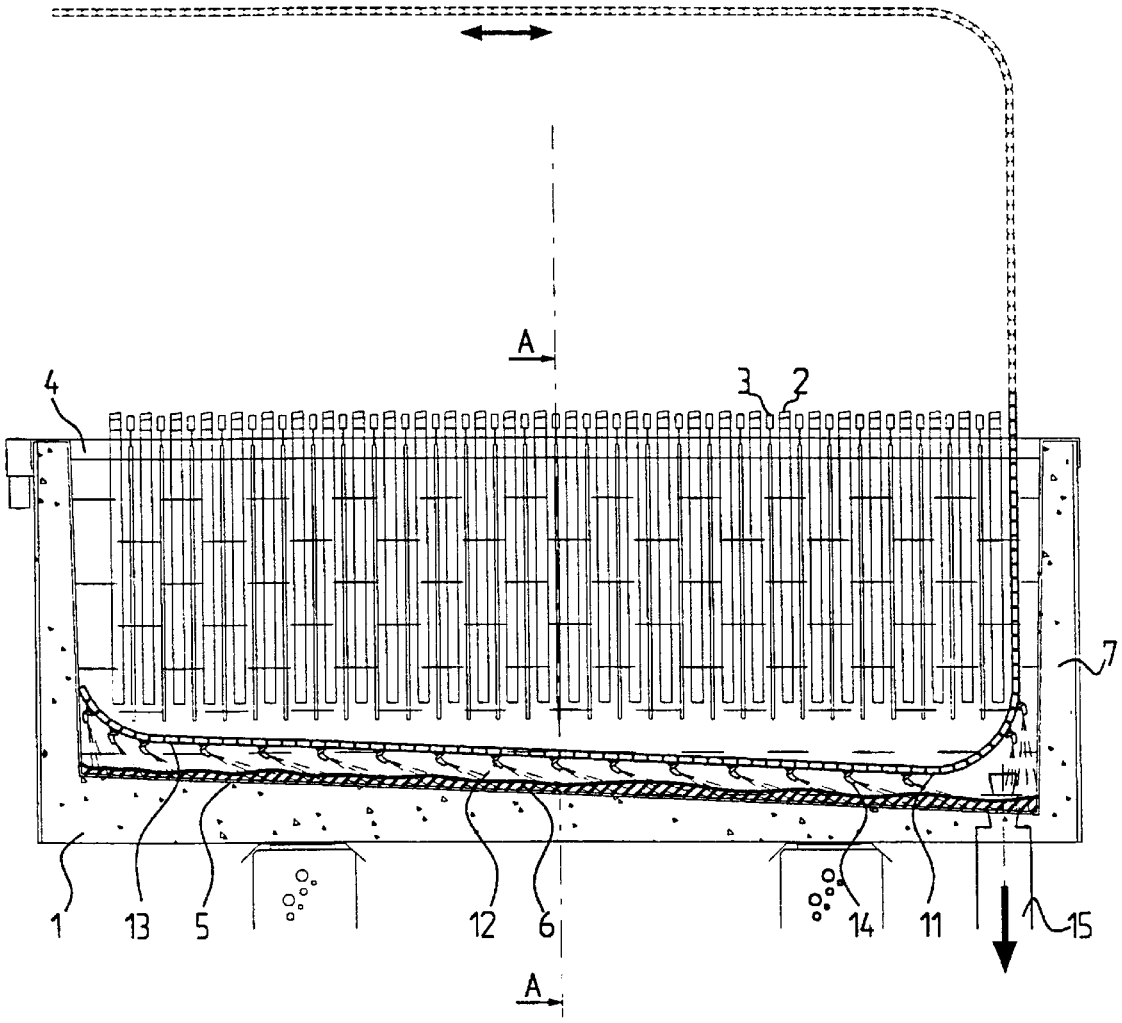

The present invention relates to a separating member for separating the bottom of an electrolytic tank from the rest of the tank in connection with removing the solids created in the electrolytic tank.

In an electrolytic process, there are precipitated metals such as copper, nickel and zinc onto the surface of cathodes provided in an electrolytic tank, either starting from metal anodes that dissolve in the electrolyte present in the electrolytic tank, or from metal ions already dissolved in the electrolyte. However, all solids are not precipitated onto the cathode surfaces; these are for example precious metals and solid impurities contained in the electrolyte. Therefore, along with a metal refining process, on the bottom of the electrolytic tank there are accumulated various solids that must from time to time be removed from the tank, for instance because the solids contain valuable ingredients, such as precious metals, or because a thicker solids accretion threatens the purity of the cathode obtained from the electrolytic process.

Generally the solids accumulated in an electrolytic tank are at least partly very finely divided and only slightly heavier than the electrolyte, wherefore it is difficult to separate the solids from the electrolyte. In the course of the electrolytic process, it is extremely harmful if the solids start circulating from the electrolytic tank bottom, because then the chance that the solids end up on the cathode is particularly great, and this would result in a substantial drop in the purity of the metal to be produced.

Generally the removal of solids accumulated on the bottom of an electrolytic tank requires that the whole electrolytic process must be interrupted, which reduces the efficiency per unit of time, i.e. the productivity of the electrolytic plant. Thus the removal of solids must be made part of the replacing process of the electrolytes, i.e. anodes and cathodes, which makes the replacing complicated and slow and restricts the solids removal to take place in a rhythm determined by said replacing exchange process. Moreover, a remarkable amount of electrolyte must first be removed from the tank and then returned therein, which generally has harmful effects on the electrolyte quality and causes a lot of extra work. In the solids treatment system, there also is conducted a remarkable amount of electrolyte, which must be replaced with a new one and may be harmful in the further processing of the solids. In addition to this, the manual washing of the electrolytic tanks makes the process clearly more labor-intensive and subjects the employees to various health hazards, for instance owing to the effect of splashes sprayed from the tank and of the ingredients contained in the spray. Likewise, owing to the number of employees needed in the manual washing of the tanks, it is often nearly impossible to automate the handling of the electrolytes, which further increases the need for labor in the electrolytic plant.

The object of the present invention is to obviate some of the drawbacks of the prior art and to realize an advanced separating member suited in electrolytic tanks in order to separate the electrolytic tank bottom from the rest of the tank, so that the removal of solids from the electrolytic tank bottom can be carried out without essentially disturbing the electrolytic process. The essential novel features of the invention are apparent from the appended claims.

According to the invention, in an electrolytic tank, advantageously in the electrolytic tank walls, there are installed support members which, in addition to providing support, also guide the path of the separating member to be installed in the electrolytic tank. Said separating member is arranged in the tank, substantially along the whole length thereof, essentially near to the tank bottom, for the duration of the removal of solids found on the tank bottom, so that the separating member separates the liquid electrolyte from the solids that are settled onto the electrolytic tank bottom that are meant to be removed.

The separating member according to the invention is manufactured of flexibly connected structure elements which form an essentially sealed surface, but which can also be bent in relation to each other. Thus the separating member can be installed in the electrolytic tank without any particular aperture made in the tank, simply by conducting the separating member onto the surface of the liquid electrolyte, and further under the surface, substantially near to the rear wall of the electrolytic tank.

When the need arises to remove the solids accumulated onto the electrolytic tank bottom, the separating member according to the invention is first conducted to above the electrolytic tank, into a space located in between the rear wall of the electrolytic tank and the electrode located nearest to said rear wall, so that one end of the separating member advantageously is substantially near to the electrolyte surface. When the separating member is started to be conducted from the transport member into the electrolytic tank, to underneath the electrolyte surface, the passage of the separating member in the electrolyte is controlled by means of support and control members attached in the electrolytic tank, advantageously in the electrolytic tank walls. Said support and control members form the trajectory of the separating member in the electrolytic tank. The support and control members attached in the vicinity of the electrolytic tank bottom are installed in the tank at such a height with respect to the electrolytic tank bottom that when moving the separating member at a speed determined by the transport member, the solids found on the electrolytic tank bottom cannot start circulating due to the motion of the separating member, and thus the solids are prevented from remixing with the liquid electrolyte.

Owing to the mutual flexibility of the structural elements of the separating member, the proceeding direction of the separating member can be changed from a substantially vertical direction in the vicinity of the rear wall of the electrolytic tank to a substantially horizontal direction in the vicinity of the side walls of the electrolytic tank, when installing the separating member in the tank. Thus the support and control members of the separating member can be arranged essentially near to both rear walls of the electrolytic tank, so that the separating member can advantageously be inserted in the electrolytic tank through a space in the vicinity of one rear wall and removed therefrom through a space in the vicinity of the other rear wall.

When the separating member according to the invention is placed in an electrolytic tank, the separating member separates the part of the tank that is located near the bottom from the rest of the tank, and simultaneously it separates the solids found on the electrolytic tank bottom from the electrolyte needed in the electrolytic process. Consequently, the space left in between the separating member and the electrolytic tank bottom can be cleared of solids without the solids getting a chance to be mixed into the liquid electrolyte present in the rest of the tank. Thus the removal of solids can be carried out while the electrolytic process is in operation, and completely separately from the electrode treatment step. When the solids have been removed from the electrolytic tank bottom, the separating member is removed from the tank by utilizing the support and control members attached in the electrolytic tank, and shifted onto a separating member conveyor provided outside the tank; said conveyor transfers the separating member to another electrolytic tank, where a corresponding removal of solids from the electrolytic tank bottom must be carried out.

The separating member according to the invention can be placed in the electrolytic tank so that in between the separating member and the opposite rear wall, there is left a substantial clearing, so that the separating member does not impermeably separate the solids located underneath the separating member from the electrolyte located above it. In that case the separating member is not strained by the weight of the electrolyte resting above it, and the space separated by the separating member is thus in connection with the space containing the electrolyte.

The separating member according to the invention can also be placed in the electrolytic tank so that the separating member separates the space left underneath the separating member, containing the solids, in a substantially impermeable fashion. In that case the separating member can advantageously be provided for example with a sealing agent filled with some liquid or gaseous substance that seals the separating member, installed in the electrolytic tank and settled in place, against the electrolytic tank walls.

In addition to the space located near the tank bottom, the separating member can also separate other spaces from the electrolytic tank, at least the space located in the vicinity of one of the rear walls, so that said space separated from the vicinity of the rear wall can advantageously be utilized for example when removing the solids.

While using a separating member according to the invention, the support and control members of the separating member can be installed in the electrolytic tank, either so that when moving the separating member, there are used only those support and control members that are located near one of the rear walls, in which case the motion of the separating member takes place back and forth; or then in the vicinity of both rear walls of the electrolytic tank there are installed support and control members, so that the separating member is inserted into the electrolytic tank through the space left in between the electrode located in the vicinity of one rear wall and said rear wall, and removed from the electrolytic tank through the space left in between the opposite rear wall and the electrode located in the vicinity thereof, in which case the motion of the separating member takes place always in the same direction.

In the separating member, there can also be connected at least part of the electrolytic tank bottom scrubbing apparatus, in which case the scrubbing apparatus enters the electrolytic tank along with the separating member. The scrubbing apparatus connected to the separating member can contain for instance washing nozzles or mechanical solids removal devices, in which case onto the electrolytic tank bottom part, there can be conducted some solids scrubbing agent, such as liquid or gas.

Figure 2:
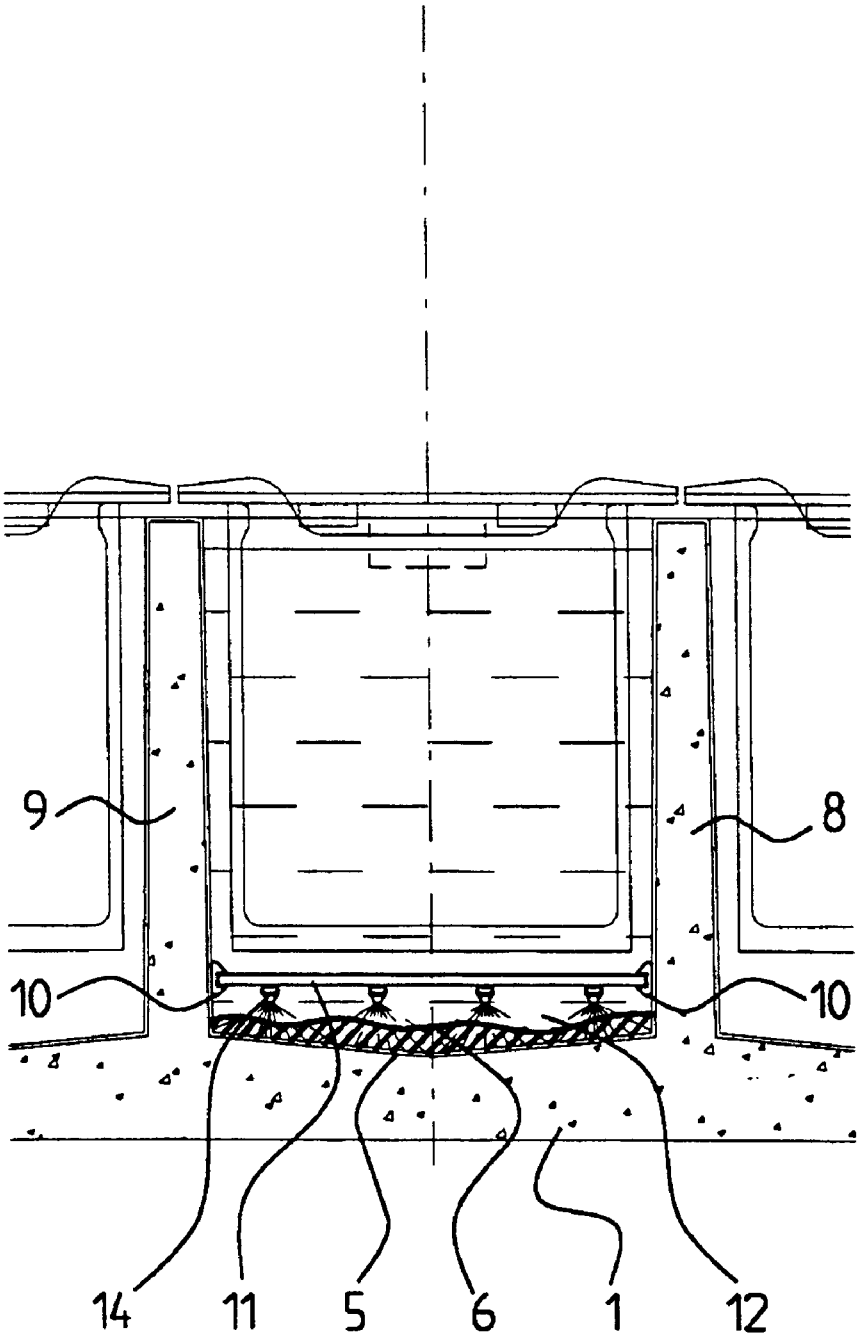
Figure 3:
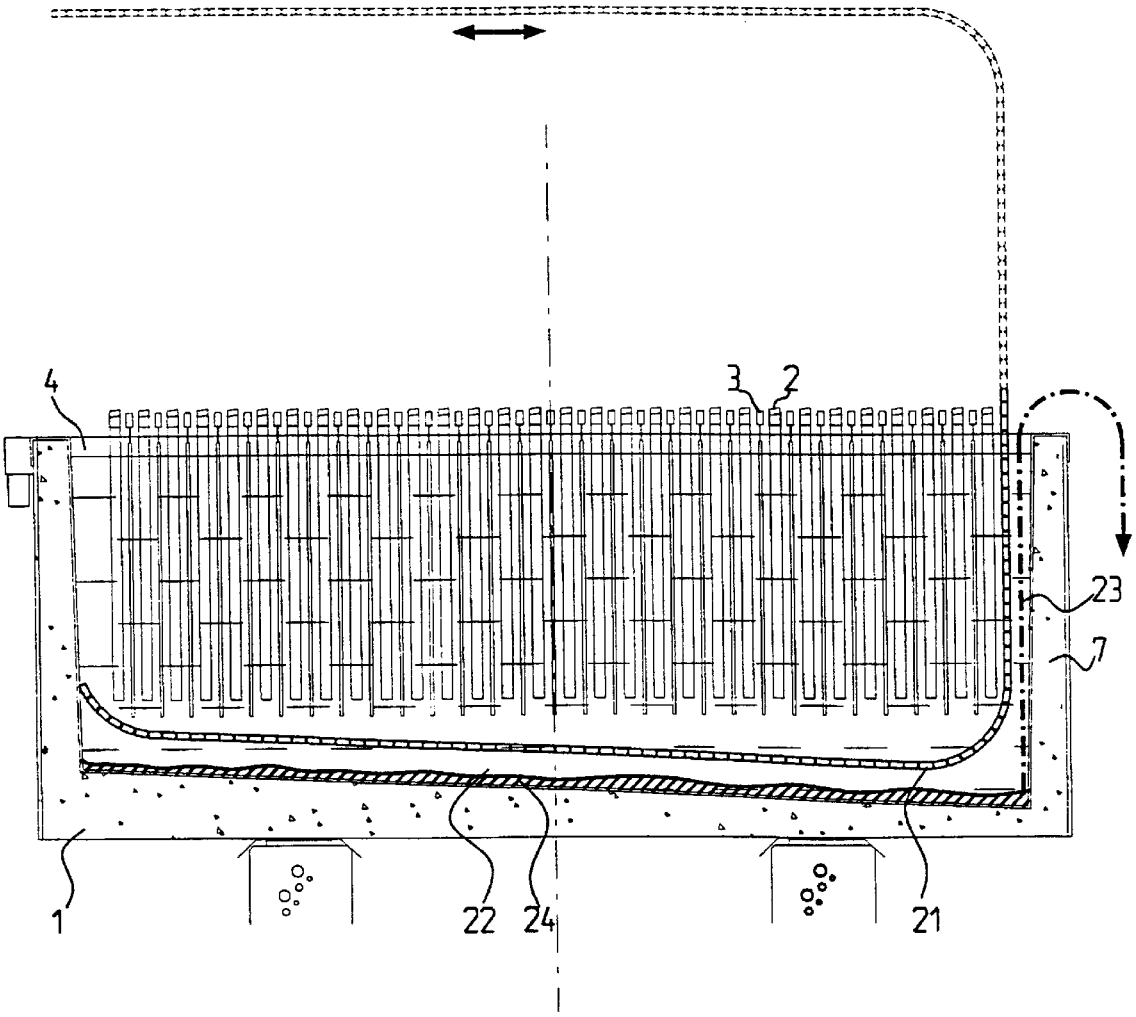
Figure 4:
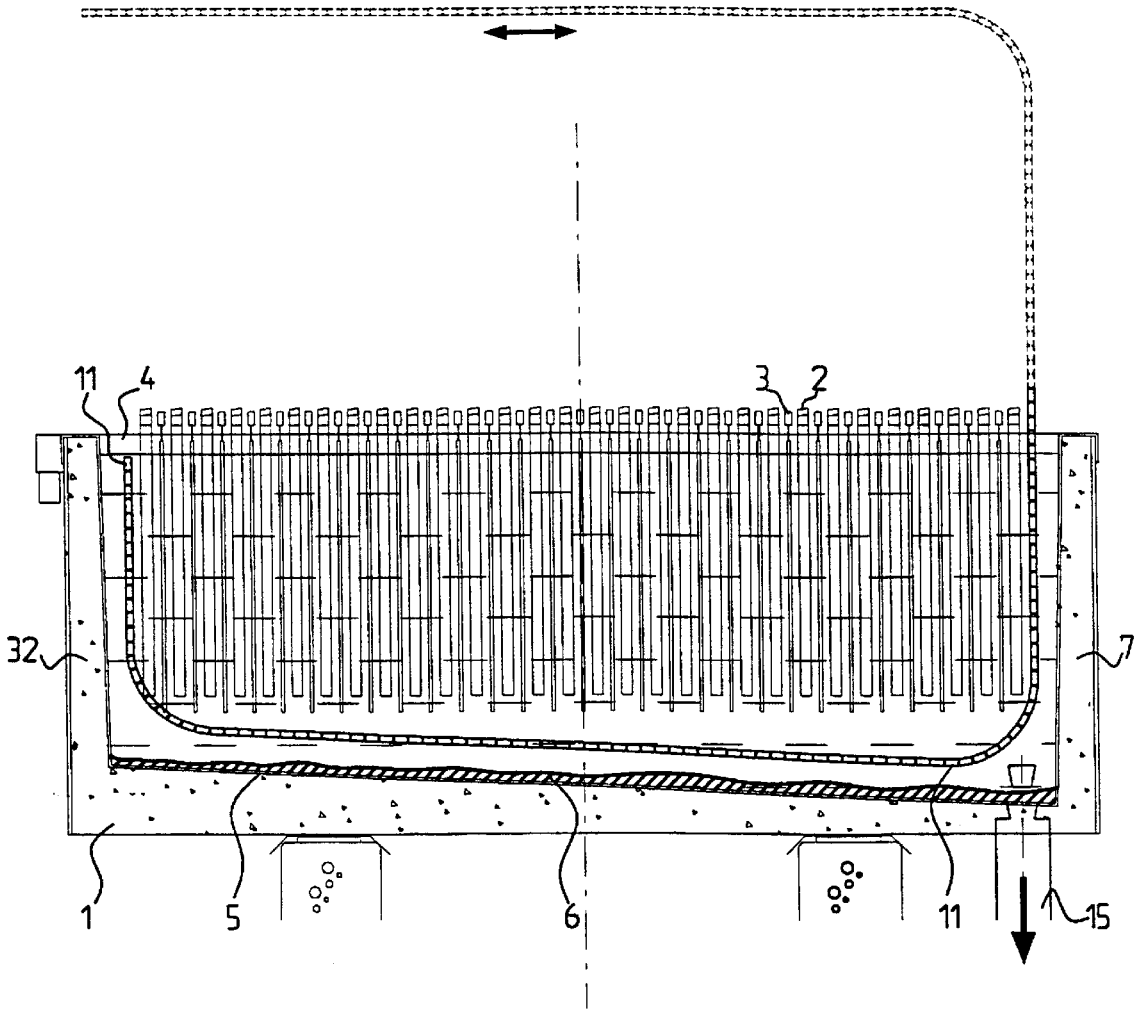

The invention is explained in more detail with reference to the appended drawings, wherein FIG. 1 illustrates a preferred embodiment of the invention in partial side-view cross-section, FIG. 2 illustrates the embodiment of FIG. 1, seen from the direction A—A, FIG. 3 illustrates another preferred embodiment of the invention, seen in a partial side-view cross-section, and FIG. 4 illustrates a third preferred embodiment of the invention, seen in a partial side-view cross-section.

According to FIGS. 1 and 2, in an electrolytic tank 1 there are placed electrodes, anodes 2 and cathodes 3, in an alternating fashion, and the metal to be produced in the electrolytic process is precipitated on the cathode 3 by means of the electrolytic solution 4 provided in the electrolytic tank 1. in the course of the electrolytic process, on the bottom 5 of the electrolytic tank, there are settled solids 6, which must from time to time be removed from the tank 1. According to the invention, on the side walls 8 and 9 of the electrolytic tank 1, there are installed support and control members 10. By means of said support and control members 10, the separating member 11 is supported when it is placed in the electrolytic tank 1, and it is conducted into the tank 1, so that the members 10 form the trajectory of the separating member 11. The separating member 11, which separates the electrolytic tank bottom part 12 containing solids 6 from the rest of the tank 1, is formed of flexibly interconnected structural elements 13, which enable an advantageous bending of the separating member 11 while proceeding from the vicinity of the rear wall 7 to the vicinity of the electrolytic tank bottom 5.

In the embodiment according to FIGS. 1 and 2, the separating member 11 is provided with nozzles 14, through which there is conducted liquid or gas into the bottom part 12 in order to facilitate the removal of solids 6. The solids 6 and the liquid left in the bottom part 12, as well as the liquid or gas fed therein through the nozzles 14, are removed from the electrolytic tank 1 via an outlet 15 provided on the electrolytic tank bottom 5.

The embodiment according to FIG. 3 differs from the embodiment of FIG. 1 in that the separating member 21 is installed in the electrolytic tank 1 in a sealed fashion. Thus the bottom part 22, separated from the electrolytic tank by means of the separating member 21, and the space 23 left in between the separating member 21 and the electrolytic tank rear wall 7, together form a substantially closed space, so that the solids 24 and the liquid found in the spaces 22 and 23 are discharged from the electrolysis via the space 23.

In FIG. 4, a separating member 11 according to FIG. 1 is placed in an electrolytic tank 1, so that support and control members 10 are installed in the electrolytic tank side walls 8 and 9 in order to ensure that the separating member 11 is inserted in the electrolytic tank for instance in the vicinity of the rear wall 7 and removed from the electrolytic tank 1 in the vicinity of the second rear wall 32.

What is claimed is:

1. Electrolytic apparatus comprising:

an electrolytic tank having a bottom and a rear wall;

electrodes suspended within the tank such that a space is formed between said electrodes and said rear wall of the tank, there being a bottom region of the tank beneath the electrodes, a separating member movable within the tank, and support and control members within the tank for guiding said separating member along a path between said space and said bottom region of the tank, and wherein when the separating member is in said bottom region of the tank it separates the electrodes from a bottom part of said bottom region of the tank and remains substantially above the bottom of the tank.

2. Apparatus in accordance with claim 1, wherein the separating member is formed of flexibly interconnected structural elements.

3. Apparatus in accordance with claim 1, wherein when the separating member separates the electrodes from the bottom part of the bottom region of the tank a portion of the separating member extends within said space, there being a region of said space between the separating member and the rear wall of the tank.

4. Apparatus in accordance with claim 3, wherein the separating member substantially isolates the bottom part of the bottom region of the tank and said region of said space from the electrodes.

5. Apparatus in accordance with claim 4, wherein the separating member is substantially impermeable to liquid electrolyte.

6. Apparatus in accordance with claim 3, wherein the bottom part of the bottom region of the tank and said region of said space are in communication with the rest of the tank.

7. Apparatus in accordance with claim 1, including a solids scrubbing apparatus attached to the separating member in order to feed scrubbing agent to the bottom part of the bottom region of the tank.

8. A method for removing solids from an electrolytic apparatus comprising a tank having a bottom and a rear wall and electrodes suspended within the tank such that a space is formed between said electrodes and said rear wall of the tank, there being a bottom region of the tank beneath the electrodes, the method comprising the steps of:

guiding a separating member along a path within said tank between said space and said bottom region of the tank such that when said separating member is in the bottom region of the tank it separates said electrodes from a bottom part of the bottom region of the tank and remains substantially above the bottom of the tank, and removing solids from said bottom part of the bottom region of the tank when said separating member is in the bottom region of the tank.

9. A method in accordance with claim 8, wherein when the separating member separates the electrodes from the bottom part of the bottom region of the tank a portion of the separating member extends within said space and forms a region of said space between the separating member and the rear wall of the tank.

10. A method in accordance with claim 9, wherein the separating member substantially isolates the bottom part of the bottom region of the tank and said region of said space from the electrodes.

11. A method in accordance with claim 10, wherein the separating member is substantially impermeable to liquid electrolyte.

12. A method in accordance with claim 9, wherein the bottom part of the bottom region of the tank and said region of said space are in communication with the rest of the tank.

13. A method in accordance with claim 8, further comprising feeding scrubbing agent to the bottom part of the bottom region of the tank.

14. A method in accordance with claim 13, wherein the scrubbing agent is a liquid.

15. A method in accordance with claim 13, wherein the scrubbing agent is a gas.

* * * * *